United States Patent [19]

Davidson

[11] Patent Number: 4,917,507

[45] Date of Patent: Apr. 17, 1990

[54] BAG

[75] Inventor: James I. Davidson, Lutterworth, England

[73] Assignee: Sidian Trading Ltd., Lutterworth, England

[21] Appl. No.: 312,440

[22] Filed: Feb. 17, 1989

Related U.S. Application Data

[63] Continuation of Ser. No. 178,521, Apr. 7, 1988, abandoned.

[51] Int. Cl.[4] ..... B65D 33/16

[52] U.S. Cl. ..... 383/67; 383/84; 383/121

[58] Field of Search ..... 383/6, 67, 84, 111, 383/121, 124, 125

[56] References Cited

U.S. PATENT DOCUMENTS

| | | | |
|---|---|---|---|
| 3,827,471 | 8/1974 | Gregory et al. | 383/67 X |
| 3,961,655 | 6/1976 | Nattrass et al. | 383/67 X |
| 4,143,796 | 3/1979 | Williamson et al. | 383/67 X |
| 4,390,051 | 6/1983 | Cuthbertson | 383/111 |
| 4,479,243 | 10/1984 | Derby et al. | 383/6 X |
| 4,646,357 | 2/1987 | Nattrass | 383/6 X |
| 4,658,432 | 4/1987 | Lehmann et al. | 383/6 X |

FOREIGN PATENT DOCUMENTS

| | | | |
|---|---|---|---|
| 2372748 | 6/1978 | France | 383/67 |
| 1431582 | 4/1976 | United Kingdom | 383/6 |
| 1591706 | 6/1981 | United Kingdom | 383/67 |
| 2127776 | 4/1984 | United Kingdom | 383/6 |

OTHER PUBLICATIONS

Flecon, Flexible Bulk Container, Mar. 1982.

*Primary Examiner*—Stephen Marcus
*Assistant Examiner*—Nova Stucker
*Attorney, Agent, or Firm*—Jones, Day, Reavis & Pogue

[57] ABSTRACT

A bag (1) for bulk transportation and storage of materials includes an aperture (2) in a bottom panel (3). An external flap (4) is provided for covering the aperture (2) when required. Fleece and hook fasteners (7, 8) are provided for holding the flap in either a first position covering the aperture, or a second position remote therefrom. For aiding lifting the bag loops (11) are attached to the bag (1) a short distance from the top thereof.

12 Claims, 1 Drawing Sheet

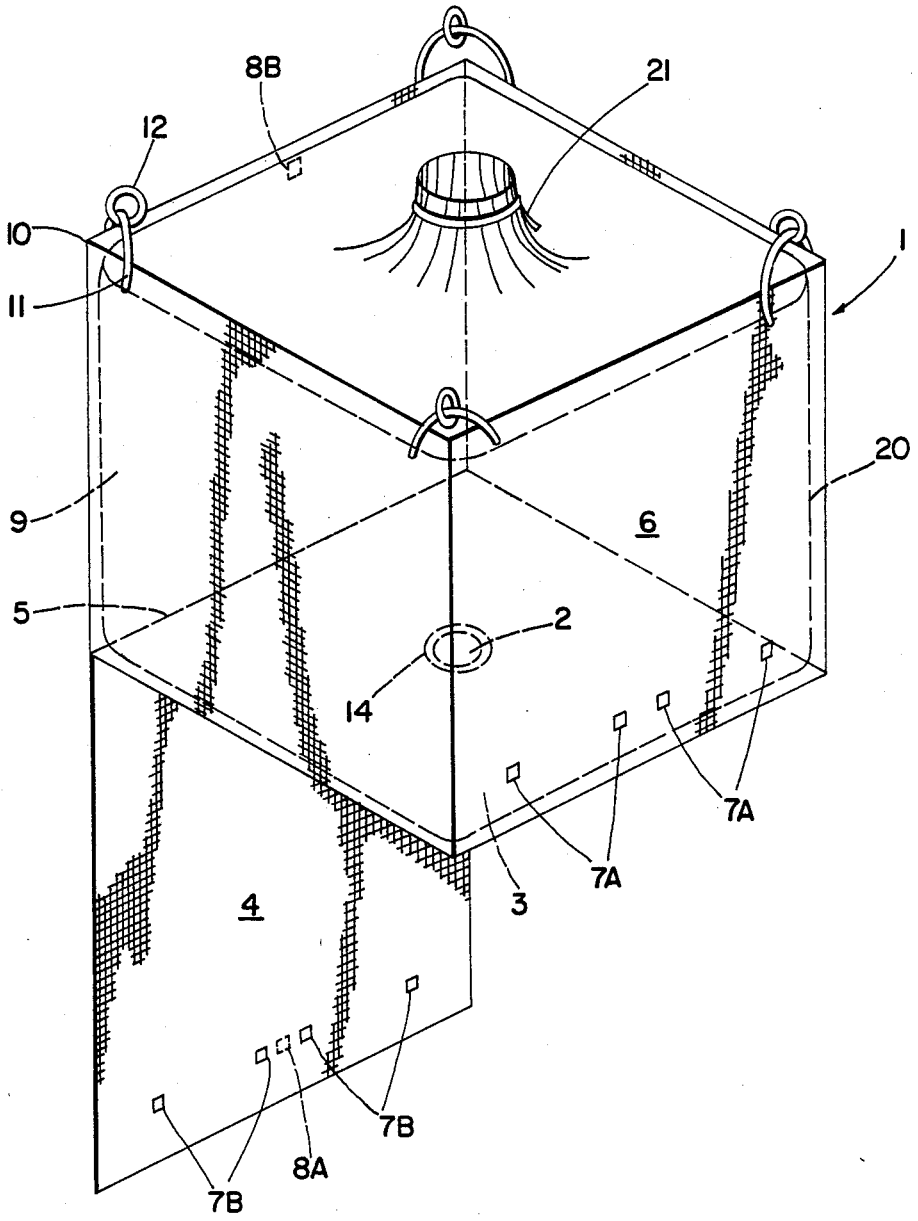
8B
21
12
10
1
11
20
9
6
5
2
14
7A
7A
3
4
7B
8A
7B

BAG

This is a continuation of copending application Ser. No. 07,178,521 filed on Apr. 7, 1988 abandoned.

BACKGROUND OF THE INVENTION

The present invention concerns a bag, particularly but not exclusively for bulk transportation and storage of materials.

Presently the use of large capacity bags is increasing greatly due to their cost effectiveness. These bags are widely used in the food industry, for example in the transportation and storage of flour, starch and other powders and also in agriculture for fertilisers and animal feedstuffs.

SUMMARY OF THE INVENTION

According to the present invention there is provided a bag comprising one or more side walls, a bottom panel provided with an aperture therein, an exterior flap attached to a wall or the bottom panel and adapted to, in one position, overlie the aperture, and one or more fleece and hook fasteners for releasably fastening the flap in said one position.

Preferably one or more fleece and hook fasteners are provided for holding the flap in an inoperative position clear of the aperture.

Preferably a bag liner is accommodated in the bag with a rupturable portion thereof covering the aperture.

Preferably a plurality of loops are secured at or near the top of the bag.

Preferably a hanger is attached to each loop.

Preferably closure means are provided at the upper end of the bag.

Preferably the side walls, bottom panel and flap are made from woven polypropolene.

Preferably the loops are made from woven polyester, and may be bound with polypropolene. Alternatively the loops may be made from woven polypropolene.

BRIEF DESCRIPTION OF THE DRAWING

The sole FIGURE of the drawing is a perspective view of a bag embodying the present invention.

DESCRIPTION OF A PREFERRED EMBODIMENT

An embodiment of the present invention will now be described by way of example only with reference to the accompanying drawing.

The drawing shows a bag 1 with four sides and a panel all made from woven polypropolene. The bag has a substantially circular aperture 2 bound with binding 14 in its bottom panel 3. A flap 4 also made from woven polypropolene is attached along the line 5 to the side 9. Secured to the side 6 of the bag 1 opposite side 9 are first components 7A of four VELCRO (Registered Trade Mark) fleece and hook fasteners 7, the corresponding components 7B being secured on the face of the flap 4 which, in use, faces the bottom panel 3. On the opposite face of the flap 4 there is secured a first component 8A of a fleece and hook fastener 8, the corresponding component 8B being secured to the outside of the side 9 near its top.

Loops 11 made from woven polyester bound with polypropolene are fixed to the bag at its corners a short distance from the top thereof. Attached to these loops 11 are woven polyester hangers 12.

In use, the components 7a and 7b of the fasteners are joined together so that the flap 4 overlies the bottom panel 3 thus closely covering the aperture 2. The bag 1 is hung under a filling machine from its hangers 12 with a lining bag 20 made from food grade polyethylene placed inside it and inflated to fill it out into the bag. The lining bag is filled and sealed. The top of the bag 1 is gathered together, bound round and tied off with cord 21.

The filled bag is now ready for transportation and storage. It can be carried by a fork-lift truck with the truck tines fitting into the loops 11. The flap 4 protects the bottom panel 3 and especially the section of lining bag spanning the aperture 2, from dirt and damage. When the bag's contents are required the bag is hung up on discharge equipment by the hangers 12, the flap 4 is pulled down after separating the components of the fastening means 7A, 7B, and the components of fastener 8 are joined together to hold the flap 4 in a position clear of the aperture 2. The exposed portion of lining bag is then punctured to release the contents of the sack. After use, the liner bag is discarded and the rest of the bag re-used.

The invention thus describes a re-usable bag which is readily transportable having loops for lifting by a fork-lift truck thus alleviating the use of pallets, and hangers for use with filling and discharge equipment. The flap on the bag protects the bottom panel and especially the section of lining sack overlying the aperture from damage and dirt, so providing a hygenic method of storing and transporting material, and avoiding contamination or discharge.

Various modifications can be made without departing from the scope of the invention. For example the bag can take different shapes from the four sided shape described above. It can have different top closure means, different loops and a different aperture position. The loops may be fixed to a support band fixed to the bag a short distance from the top such that when the bag is held or lifted by the loops its weight is distributed along the length of the support band. The lining bag may be replaced by a sheet totally or partially covering the inner surface of the base panel and held in position by the weight of the bag's contents. The fleece and hook fastener components 7A may be attached to a short flap sewn onto the side of the bag.

I claim:

1. A bag comprising at least one sidewall, a bottom panel provided with an aperture therein, the periphery of said aperture being substantially coplanar with the bottom panel, said aperture also defining the discharge outlet for said bag such that once material within the bag passes through the aperture the material is completely unconfined by any part of the bag and is freely in the external environment, a liner within the bag covering at least part of the bottom panel and having a continuous rupturable portion in registry with the aperture, an exterior flap attached at one of its edges to the exterior of the bag and adapted in one position to overlie the aperture and the rupturable portion of the liner to protect the aperture and the rupturable portion during handling of the bag, said rupturable portion of said liner comprising the sole means for completely closing said aperture against discharge of the bag contents therethrough, said flap in said one position thereof having the sole purpose of covering and protecting said aperture and said rupturable portion of said liner during handling of the bag, and a fastener for releasaby fastening the flap in said one position, the flap and the fastener being attached to the bag at positions spaced from the aperture, whereby the flap may be released away from the area of the aperture and will hang clear of the aperture when released.

2. A bag as claimed in claim 1 including fastener means for selectively holding said flap in a remote position clear of said aperture when said flap is released from said one position overlying said aperture.

3. The bag as claimed in claim 2 wherein said fastener means is located for selectively holding said flap against said sidewall of said bag.

4. A bag comprising at least one sidewall, a bottom panel provided with an aperture therein, the periphery of said aperture being substantially coplanar with the bottom panel, a liner within the bag covering at least a part of said bottom panel and having a continuous rupturable portion in registry with the aperture, an exterior flap attached at one of its edges to the exterior of the bag and adapted in one position to overlie the aperture and the rupturable portion of the liner to protect the aperture and the rupturable portion during handling of the bag, and a fastener for releasably fastening the flap in said one position, said fastener being positioned on the sidewall of the bag, whereby the flap may be released without contact with the bottom panel.

5. A bag as claimed in claim 4 wherein the flap is attached to the exterior of the bag at the junction of the bottom panel and the sidewall, whereby the flap hangs clear of the aperture when released.

6. A bag as claimed in claim 4 wherein the flap covers the entire bottom panel of the bag.

7. A bag comprising at least one sidewall, a bottom panel provided with an aperture therein, the periphery of said aperture being substantially coplanar with the bottom panel, a liner within the bag covering at least part of said bottom panel and having a continuous rupturable portion in registry with the aperture, an exterior flap attached at one of its edges to the exterior of the bag at the junction of the bottom panel and the sidewall and adapted in one position to overlie the aperture and the rupturable portion of the liner to protect the aperture and the rupturable portion during handling of the bag and in another position to hang clear of the aperture, and a fastener for releasably fastening the flap in said one position.

8. A bag as claimed in claim 7 wherein the fastener is positioned on the sidewall of the bag, whereby the flap may be released without contact with the bottom panel.

9. A bag as claimed in claim 7 wherein the flap covers the entire bottom panel of the bag.

10. A bag comprising at least one sidewall, a bottom panel provided with an aperture therein, the periphery of said aperture being substantially coplanar with the bottom panel, a liner within the bag covering at least part of said bottom panel and having a continuous rupturable portion in registry with the aperture, an exterior flap covering the entire bottom panel of the bag, attached at one of its edges to the exterior of the bag and adapted in one position to overlie the aperture and the rupturable portion of the liner to protect the aperture and the rupturable portion during handling of the bag, and a fastener for releasably fastening the flap in said one position.

11. A bag as claimed in claim 10 wherein the fastener is positioned on the sidewall of the bag, whereby the flap may be released without contact with the bottom panel.

12. A bag as claimed in claim 10 wherein the flap is attached to the exterior of the bag at the junction of the bottom panel and the sidewall, whereby the flap hangs clear of the aperture when released.

* * * * *